United States Patent [19]

Simington

[11] 4,029,076

[45] June 14, 1977

[54] FIREPLACE OPENING ENCLOSURE

[76] Inventor: Jack F. Simington, Box 141, Star Route, Chiloquin, Oreg. 97624

[22] Filed: Nov. 17, 1975

[21] Appl. No.: 632,799

[52] U.S. Cl. ..... 126/140; 126/202

[51] Int. Cl.[2] ..... F24C 15/04

[58] Field of Search ..... 126/140, 202, 138, 164, 126/165; 160/DIG. 9, 88; 292/202

[56] References Cited

UNITED STATES PATENTS

| | | | |
|---|---|---|---|
| 280,946 | 7/1883 | Nordyke | 160/88 |
| 2,077,324 | 4/1937 | Horner | 126/140 |
| 2,294,046 | 8/1942 | Cser | 126/202 |
| 2,707,946 | 5/1955 | Merryweather et al. | 126/140 |
| 3,457,907 | 7/1969 | Brunig | 126/140 |

FOREIGN PATENTS OR APPLICATIONS

| | | | |
|---|---|---|---|
| 19,609 | 8/1912 | United Kingdom | 126/140 |

*Primary Examiner*—John J. Camby
*Assistant Examiner*—Larry I. Schwartz
*Attorney, Agent, or Firm*—Clarence A. O'Brien; Harvey B. Jacobson

[57] ABSTRACT

A bay window-type of metal enclosure is provided for the opening of a fireplace including a hearth extending outwardly beyond the lower portion of the fireplace opening. The enclosure includes a downwardly opening U-shaped frame for abutting the marginal portions of the front wall of the fireplace surrounding the opening, a horizontally outwardly projecting top wall supported from the upper horizontal portions of the U-shaped frame and a lower partial front wall projecting outwardly from and extending between the lower ends of the legs of the U-shaped frame, the opposite side marginal portions of the top wall and the opposite ends of the partial front wall being inwardly divergent and the outer marginal portion of the top wall and the central portion of the partial front wall generally paralleling the front wall of the fireplace through which the fireplace opens. Horizontally swingable opposite side and partial front wall door assemblies each including a pair of relatively swingable doors are provided and each door assembly has one door thereof pivotally supported from the corresponding leg of the U-shaped frame for swinging about a horizontal axis and the other door of each door assembly is swingable relative to the first door about a vertical axis. The door assemblies may be swung to closed positions in closing those open portions of the bay window-type enclosure extending between the low partial front wall and the top wall thereof and open positions swung outwardly of remote sides of the legs of the U-shaped frame, the free swinging edge portions of the door assemblies including upper latching structure with which further latching structure carried by the center portion of the top wall of the enclosure may coact to retain the door assemblies in the closed positions, the doors of the door assemblies each including large openings formed therein close by means of transparent panels, the center portion of the low partial front wall including a damper controlled draft air inlet and the top wall including a shiftable damper control for operative association with the existing damper in the flue of the associated fireplace.

6 Claims, 6 Drawing Figures

FIREPLACE OPENING ENCLOSURE

BACKGROUND OF THE INVENTION

Various forms of glass panel equipped enclosures have been heretofore provided for fireplace openings. Examples of such enclosures are disclosed in U.S. Pat. Nos. 411,262, 1,470,542, 1,590,396, 1,832,680, 3,457,907 and 3,372,689.

However, these previous different forms of fireplace enclosures have not been constructed so as to afford maximum heat radiation from the fireplace, a minimum of combustion supporting draft air access into the fireplace from the associated room, less glass breakage due to excessive heat encountered by the transparent glass panels, maximum aesthetic appearance, remote control of the associated fireplace damper from exteriorly of the fireplace enclosure, minimum cooling effect of draft air entering the fireplace enclosure and ease of maintenance of the various components of the enclosure which may require occasional maintenance.

BRIEF DESCRIPTION OF THE INVENTION

The fireplace opening enclosure of the instant invention has been constructed in a manner to provide maximum efficiency, a pleasing appearance and trouble free operation. Its major components are constructed of cast-metal and accordingly offer an extended life expectancy. In addition, the swingable door assemblies are readily removable for performing maintenance operations thereon and the glass panels supported from the doors are readily removable for cleaning and/or replacement should they become accidently broken.

The main object of this invention is to provide a fireplace enclosure which will afford maximum radiation of heat from a fireplace into an associated room.

Another object of this invention is to provide an enclosure which will afford a pleasing appearance.

Still a further object of this invention is to provide a fireplace enclosure constructed in a manner whereby access to the interior of the associated fireplace for cleaning and/or placing fuel therein is readily obtained.

Yet another object of this invention is to provide a fireplace enclosure with draft air inlet means of such a type to provide a minimum of draft air flow from the associated room into the interior of the fireplace enclosure.

Another object of this invention, in accordance with the immediately preceding objects is to provide a draft air inlet so positioned and oriented relative to the enclosure whereby the cooling effect of draft air entering the interior of the enclosure and the associated fireplace will have a minimal cooling effect on the fire and the heat radiated from the fireplace through the enclosure.

A further important object of this invention is to provide a fireplace enclosure including glass panels oriented relative to the fireplace opening in such a manner as to minimize the possibility of breakage of the glass panels due to their experiencing excess heat.

A final object of this invention to be specifically enumerated herein is to provide a fireplace enclosure in accordance with the preceding objects and which will conform to conventional forms of manufacture, be of simple construction and easy to use so as to provide a device which will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 4:
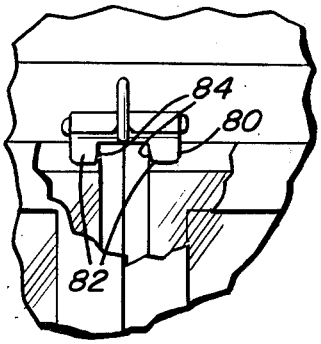
FIG. 4 is a fragmentary front elevational view of the latching structure by which the swingable door assemblies of the enclosure may be latched in the closed position, portions of the adjacent free swinging edge portions of the door assemblies being broken away and illustrated in vertical section.
Figure 2:
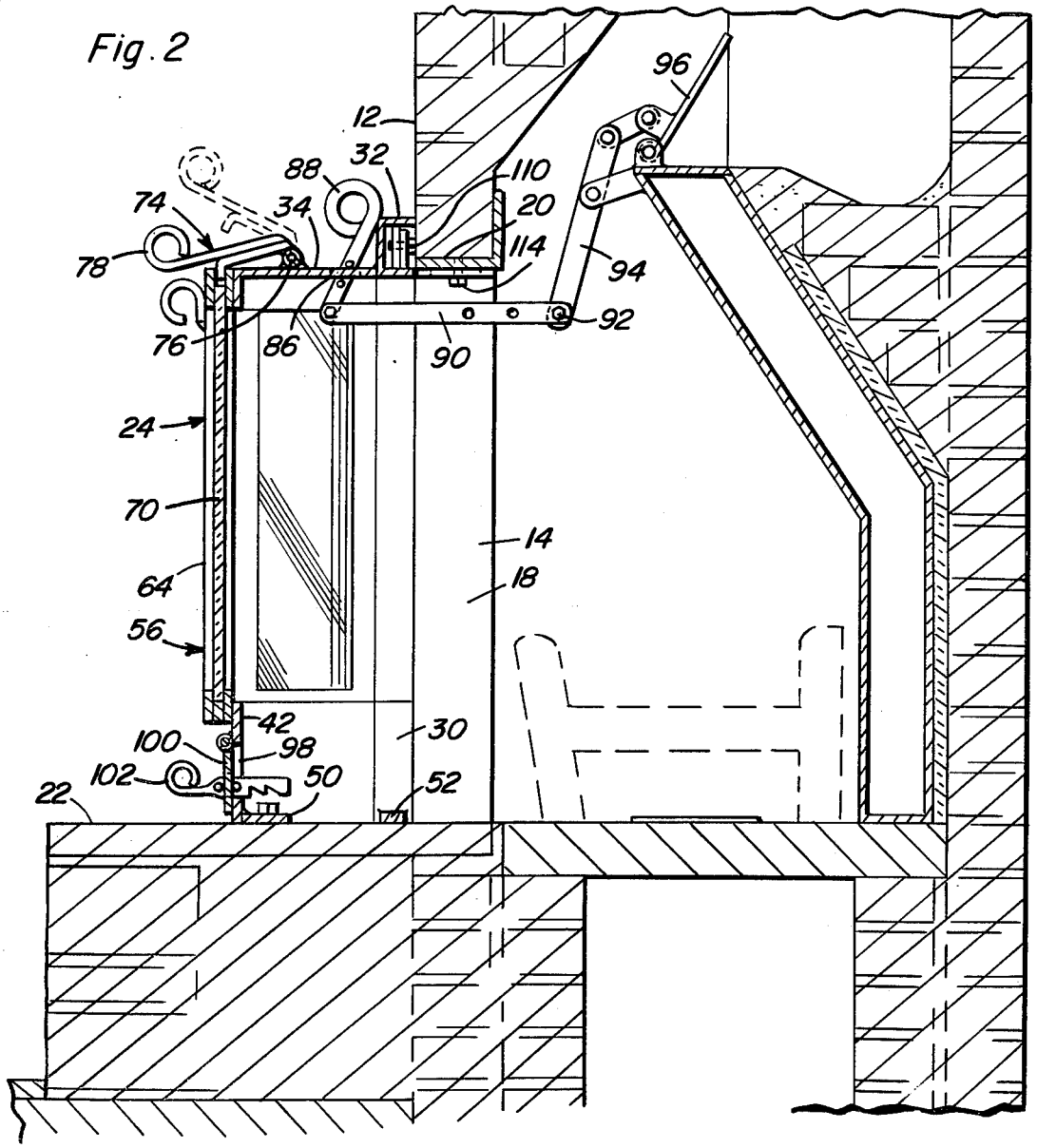
FIG. 2 is a fragmentary enlarged vertical sectional view taken substantially upon the plane indicated by the section line 2—2 of FIG. 1.
Figure 3:
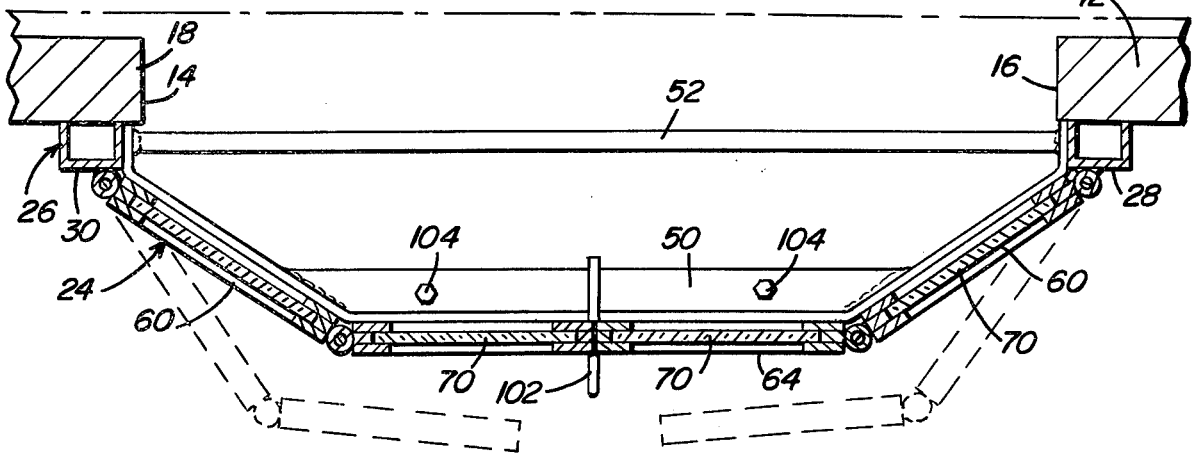
FIG. 3 is an enlarged fragmentary horizontal sectional view taken substantially upon the plane indicated by the section line 3—3 of FIG. 1.

Referring now more specifically to FIGS. 2, 3 and 4 of the drawings, there may be seen a conventional fireplace construction referred to in general by the reference numeral 10 and which may include a form of fireplace liner defining room air flow convection passages through the lower ends of which cool room air to be heated may be inducted and from whose upper outlets heated convection air may be exhausted back into the room. The fireplace construction 10 includes a front wall 12 in which a fireplace opening 14 is formed. The opening 14 includes opposite side marginal portions 16 and 18 and an upper marginal portion 20. In addition, the fireplace construction 10 includes a horizontally outwardly projecting hearth 22 extending outwardly beyond the lower marginal portion of the opening 14.

The fireplace enclosure of the instant invention is referred to in general by the reference numeral 24 and includes a main frame of generally inverted U-shaped configuration referred to in general by the reference numeral 26 consisting of a pair of upstanding channel-shaped legs 28 and 30 opening toward and abutted against front wall 12 on opposite sides of the opening 14 and interconnected at their upper ends by means of an upper horizontal channel member 32 also opening toward and abutting against the outer surface of the front wall 12.

The enclosure 24 further includes a trapezoidal-shaped top wall 34 secured to and projecting outwardly from the lower flange of the channel-shaped horizontal member 30. The top wall 34 includes outwardly convergent side marginal edges 36 and 38 and an outer center marginal edge 40 which generally parallels the corresponding portions of the front wall 12.

The enclosure 24 further includes a low partial front wall 42 including a central portion 44 spaced below and paralleling the marginal edge 40 of the top wall 34 and opposite end sections 46 and 48 spaced below and generally paralleling the opposite side edges 36 and 38 of the top wall 34. The ends of the end sections 46 and 48 remote from the center portion 44 are secured to the inner sides of the channel-shaped legs 28 and 30 and a forward horizontal bracing flange 50 is secured along the inner side of the lower marginal portion of the central portion 44 and the adjacent ends of the end sections 46 and 48 and rests upon the hearth 22. Still further, a brace 52 extends between and is secured to the lower ends of the legs 28 and 30 and also rests upon the hearth 52.

The enclosure 24 includes a pair of opposite side door assemblies referred to in general by the reference numerals 56 and 58 and each door assembly 56 and 58 includes a first door 60 hingedly secured to the corresponding leg of the frame 26 by means of a vertical hinge 62 and a second door 64 swingably supported from the free end of the corresponding door 60 by means of a second vertical hinge 66. The doors 60 and 64 include large openings 68 formed therein and the openings 68 are closed by means of transparent glass panels 70 telescoped down into the doors 60 and 64 from the upper ends thereof through which glass panel receiving slots open. The hinge assemblies 62 and 66 include removable pins whereby the door assemblies 56 and 58 may be removed from the frame 26 and each pair of doors 60 and 64 may be separated from each other. Of course, should one of the panels 70 be accidentally broken it may be readily replaced.

The width of each door 60 is equal to the length of the corresponding side edge of the top wall 34 and the width of each door 64 is equal to approximately one half the length of the edge 40 of the top wall 34. Accordingly, the free edges of the doors 64 are disposed in closed juxtaposed position when the doors 60 and 64 are in the closed positions illustrated in FIG. 1.

A latching lever referred to in general by the reference numeral 74 is hingedly supported from the central portion of the top wall 34 as at 76 and includes a forwardly projecting finger receiving ring-type handle 78 and a depending bifurcated latching flange 80 whose furcations 82 include slightly downwardly divergent opposing side edges 84 defining cam surfaces. The furcations 80 are receivable down into the glass receiving slots of the center doors 64 at the adjacent ends of those slots and with the cam surfaces 84 camming the adjacent edges of the doors 64 together while at the same time retaining the doors 64 tightly against the marginal edge 40 of the top wall 34. Accordingly, the latching lever 74 serves a dual function.

The rear central portion of the top wall 34 has a slot 86 formed therethrough and an operating lever 88 extends through the slot and is oscillatably supported from the top wall 34 with the lower end of the lever 88 projecting downwardly into the interior of the enclosure and equipped with a pivotably supported connecting link 90 at its forward end. The rear end of the connecting link 90 is pivotally connected as at 92 to the damper actuating lever 94 of the conventional damper 96 provided with the fireplace construction 10. In addition, the central portion 44 of the partial front wall 42 includes a center draft opening 98 formed therethrough having a pivoted damper door 100 operatively associated therewith including an oscillatably supported and toothed door propping lever 102 whereby the door 100 may be propped in adjusted open positions to control the amount of draft air entering the enclosure 24.

The flange 50 may be secured to the hearth 22 by means of suitable anchors 104 secured downwardly through the flange 50 and in the hearth 22. In addition, a pair of L-shaped mounting brackets 106 are provided and include short apertured flanges 108 secured by means of fasteners 110 (See FIG. 2) to the upper horizontal channel-shaped member 32 and along longitudinally slotted flanges 112 secured by means of fasteners 114 (See FIG. 2) to the portion of the front wall 12 defining the upper marginal portion of the opening 14.

In essence, the vertical and horizontal portions of each of the doors 60 and 64 define channel members and the aforementioned glass panel receiving slots are formed in the upper horizontal members of each of the doors 60 and 64 whereby the glass panels 70 may be readily removed from the doors and replaced therein whenever desired such as when it is deemed necessary to clean the glass panels.

Figure 1:
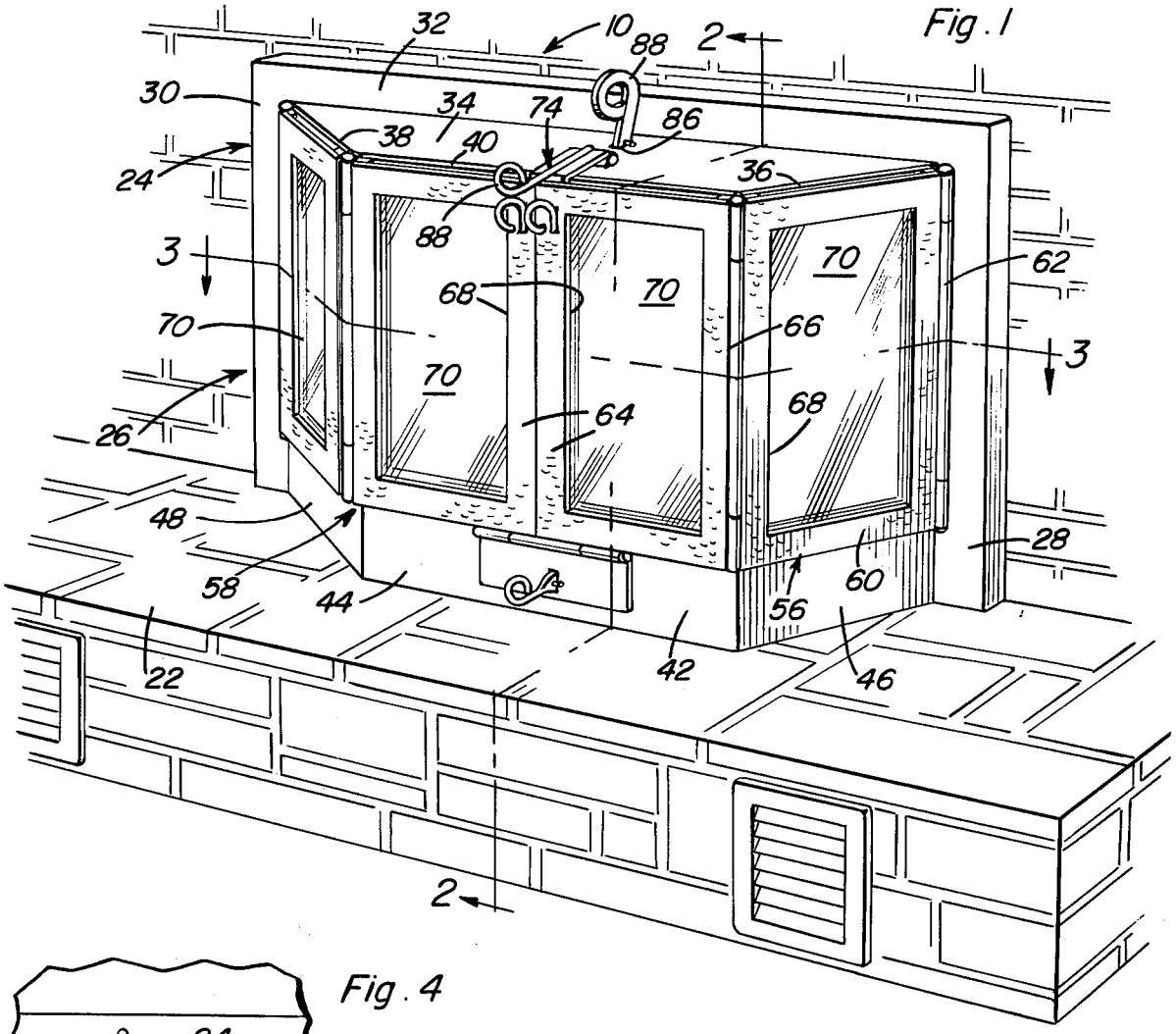
FIG. 1 is a fragmentary perspective view of a fireplace structure with a first form of enclosure constructed in accordance with the present invention operatively associated with the fireplace opening.

From an observation of FIG. 1, it will be noted that persons within the room into which the fireplace opening 14 opens may view a fire within the fireplace through one of the glass panels 70 without their line of vision being excessively inclined relative to the closer glass panels. Further, the configuration of the enclosure 24 insures that the glass panels 70 will be appreciably spaced from a fire within the fireplace (note also FIG. 2). Still further, the bay window-type of construction of the enclosure 24 offers maximum transparent panel sections through which heat from within the fireplace may radiate and also maximum solid metal sections to be heated from heat within the fireplace and subsequently radiated therefrom into the associated room. In addition, the overall configuration of the enclosure 24 presents a pleasing appearance.

Inasmuch as the draft air inlet opening 98 is confined solely to the central area of the central portion 44 of the partial front wall 42, the cooling effect of draft air entering the fireplace enclosure 24 is maintained at a minimum. Further, the draft air inlet opening 98 is substantially centered relative to the fire within the fireplace and therefore affords maximum support of combustion of fuel within the fireplace for a minimum amount of draft air drawn into the fireplace enclosure 24 from the associated room.

Figure 6:
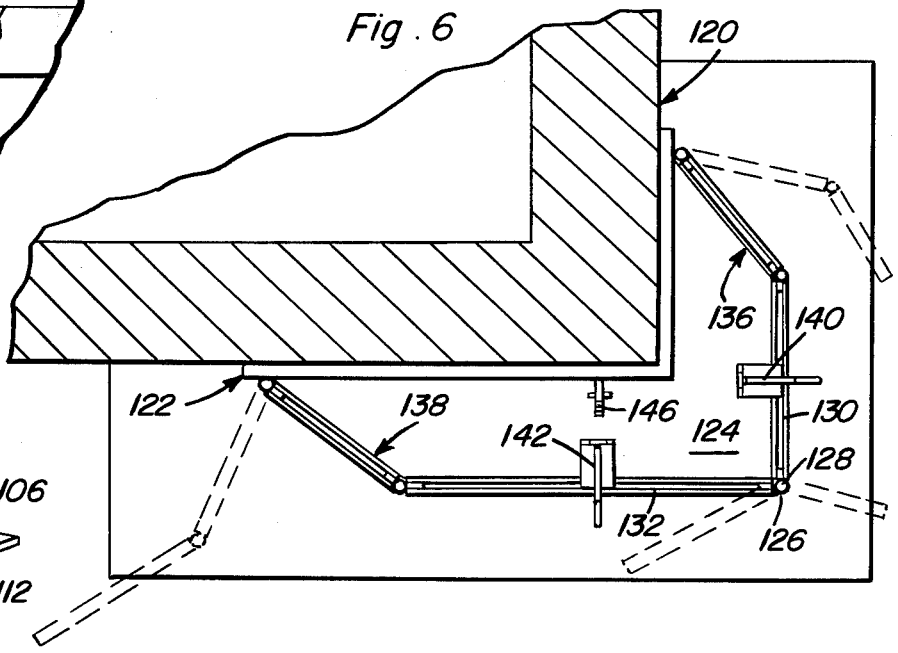
FIG. 6 is a fragmentary horizontal sectional view taken substantially upon a plane passing through a corner fireplace and illustrating a modified form of fireplace enclosure operatively associated therewith.
Figure 5:
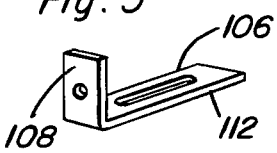
FIG. 5 is a perspective view of one of the brackets which may be utilized to mount the fireplace enclosure in position relative to an associated fireplace opening.

With attention invited now more specifically to FIG. 6 of the drawings, there will be seen a corner-type of fireplace construction referred to in general by the reference numeral 120 and a modified form of fireplace enclosure referred to in general by the reference numeral 122 is operatively associated with the fireplace construction 120. The fireplace enclosure 122 is substantially identical to the fireplace enclosure 24, except that the top wall 124 thereof is of a configuration to extend around the corner of the fireplace construction 120 and the apex portion 126 of the fireplace enclosure 122 includes a vertically extending hinge assembly 128 from which a pair of independently swingable doors 130 and 132 are hingedly supported. The doors 130 and 132 are merely provided in addition to the door assemblies 136 and 138 corresponding to the door assemblies 56 and 58 in order to enclose the apex portion 126 of the enclosure 122. The top wall 124 includes a pair of latching levers 140 and 142 which correspond to the latching lever 74 and which coact the free swinging edge of the door 130 and the door assembly 136 and the free swinging edge of the door 132 and the door assembly 138 to maintain these doors and door assemblies in their closed positions. In addition, the fireplace enclosure 122 includes an operating lever 146 corresponding to the operating lever 88.

In lieu of the lever 146, if the actuating lever 94 projects sufficiently downwardly below the upper marginal portion 20 of the opening, the lever 146 and connecting link 90 may be replaced by a single elongated actuating link (not shown) inclined rearwardly and downwardly through slot 86 and pivotally attached to the lower end of such a more downwardly projecting actuating lever. Further, the rear ends of the sections 46 and 48 remote from the center portion 44 may include front to rear extending flanges (not shown) adjustably attached by means of fasteners secured therethrough and also through corresponding flanges (not shown) projecting rearwardly from the lower inner marginal portions of the legs 26 and 28 in order to enable angular adjustment of the partial front wall 42 relative to the frame 26 in the event the hearth 22 is not disposed at a right angle relative to the outer face of the front wall 12 and front-to-rear adjustment of the partial front wall 42 relative to the frame 26 in order to insure tight sealing engagement of the lower portions of the door assemblies 56 and 58 against the partial front wall 42.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a fireplace opening including opposite side walls, a top wall and a lower hearth extending outwardly beyond said opening, an enclosure for said opening, said enclosure comprising a downwardly opening frame including a pair of upstanding opposite side members extending along the outer faces of said side walls and an upper horizontal member extending and connected between the upper ends of said upstanding members, said upper member extending along and conforming to the general contour of the front face of said top wall extending between the upper ends of said side walls, an elongated horizontal top panel extending along and supported from the lower marginal portion of said horizontal member and projecting outwardly of the latter, the opposite and edge portions of said top panel being angled outwardly toward the remote ends thereof, said top panel including an outer marginal edge extending between the outer ends of said end edge portions generally paralleling the front face of said top wall, a lower partial front wall closely overlying said hearth, spaced below said top wall and including a central portion generally paralleling said outer marginal edge and angled opposite end sections spaced below and generally paralleling said end edge portions with the remote ends of said angled end sections anchored to the lower ends of said side members, a pair of door assemblies, each door assembly comprising first and second door sections pivotally joined together along adjacent upstanding edges thereof, the upstanding edge of each first door section remote from the corresponding second door section being hinged from a corresponding side member of said frame and each door assembly being swingable into and out of position with its first door section closing that portion of the spacing between the adjacent angled end edge of said top wall and the corresponding lower front wall end section and its second door section bridging the adjacent ends of said top panel outer marginal edge and said lower partial front wall central portion, said door sections having openings formed therethrough closed by means of heat resistant transparent panels, the ends of upper marginal portions of the second door sections remote from the corresponding first door sections and said top panel including coacting latch means operative to releasably retain said door assemblies in the closed positions thereof, said lower partial front wall including a draft opening formed therethrough, said top panel outer marginal edge and said lower front wall central portion being substantially straight throughout their horizontal extent and the upstanding edges of said second door sections remote from the corresponding first door sections are disposed in at least close juxtaposition said door assemblies are in their closed positions, said coacting latch means including a single latch element shiftably supported from said top panel and simultaneously engageable with said second door sections, said single latch element and the upper marginal portions of said second door sections including coacting cam surfaces functioning to draw the upstanding edges of said second door sections toward each other as a result of said latch means being actuated to retain said door assemblies in the closed positions thereof.

2. The combination of claim 1 wherein said lower partial front wall includes a draft opening formed therethrough confined to the central portion of said lower partial front wall.

3. In combination with a fireplace structure including an outer wall having an opening formed therein including opposite side surfaces, a top surface and a lower hearth extending outwardly of the lower marginal portion of said opening, an enclosure for said opening including an upright frame defining at least a pair of upright opposite side members and a horizontal member extending between and interconnecting the upper ends of said side members, said frame being positioned in juxtaposition with the outer surfaces of said outer wall extending about said opening, a generally trapezoidal top wall supported from and projecting horizontally outwardly from said horizontal member and including inwardly divergent and marginal portions, a low partial front wall including a central portion spaced beneath and paralleling the outer marginal edge of said top wall and angulated end sections spaced beneath and generally paralleling said end marginal portions, the remote ends of said end sections being secured to the lower ends of said upright side members, a pair of opposite side door assemblies each including relatively hingedly connected horizontally swingable base and free swinging doors, the base doors being hinged from corresponding upright side members of said frame for horizontal swinging relative thereto, the width of said base and free swinging doors being substantially equal to the length of the corresponding top wall end marginal portion and one-half the length of the outer top wall marginal edge extending between said end marginal portions, respectively, and said door assemblies being swingable to closed positions closing the spacing between said top wall and said low partial front wall with the upstanding edge portions of said free swinging doors remote from said base doors in close juxtaposed positions said doors having large openings formed therethrough, transparent glass panels closing said openings, the upper portions of said juxtaposed upstanding edge portions of said free swinging doors and the central forward portion of said top wall including coacting latch means releasably securing said door assemblies in the closed positions, said latch means including means operable to releasably cam said juxtaposed upstanding edge portions of said doors together and means releasably locking said juxtaposed upstanding edge portions against movement away from the outer marginal portion of said top wall.

4. The combination of claim 3 wherein said fireplace assembly includes an oscillatable damper control inwardly of said outer wall, an operating lever secured downwardly through and oscillatable relative to said top wall with an upper portion of said lever projecting upwardly above said top wall and a lower portion of said lever projecting below said top wall, and connecting means connected between the lower end of said operating lever and said damper control for oscillation of the former in response to oscillation of the latter.

5. In combination with a fireplace assembly of the type including an outer upstanding wall, a fireplace opening therein opening outwardly through said wall and a lower horizontal hearth projecting horizontally outward from the lower marginal edge of said opening, an enclosure for said opening, enclosure defining a rearwardly and downwardly opening housing including interconnected horizontal top and upstanding front and opposite side walls, said housing being disposed on said hearth with its rear side, opening against the surfaces of said outer wall disposed about said opening, said side walls of said housing being rearwardly divergent and said front and side walls defining a horizontally continuous access opening spaced above the lower marginal portions of said front and side walls extending across the front wall and into the opposite side walls of said housing, a pair of opposite side door assemblies each including a base door and a free door, said doors including adjacent upstanding side edges pivotally joined together for relative angular displacement about an upright axis and the upstanding edge of each base door being pivotally supported from the corresponding side wall of said housing adjacent the extremity of that side of said access opening and for oscillation of said base doors about upstanding axes, said base doors being of widths corresponding to widths of the end portions of said access opening formed in said side walls and swingable into and out of positions closing said access opening end portions and said free doors being swingable into and out of positions closing the adjacent portion of the portion of said access opening formed in said front wall, said top wall and the upper portions of the marginal portions of said free doors remote from said base doors including coacting latch means operable to retain said door assemblies in the closed positions thereof, said doors having openings formed therethrough closed by means of transparent heat resistant panels, said outer upstanding wall including a pair of adjacent upstanding substantially right angularly disposed wall sections defining an outside corner through which said fireplace opening opens, said top wall including inner and outer marginal portions having opposite end sections paralleling said wall sections and said front wall including opposite end sections spaced below the end sections of said outer marginal portion and paralleling said wall sections, said free doors closing only those portions of said access formed in portions of said front wall end sections adjacent said side walls, and a third pair of doors pivotally supported from said housing along adjacent upstanding edge portions of said third pair of doors for oscillation about an upstanding axis extending between the apex portion of said outer marginal portion of said top wall at the intersection of said opposite end sections of said top wall outer marginal portion and the apex portion of said front wall at the intersection of said opposite end sections said each of said third pair of doors and the corresponding free door being coplanar when the door assemblies and said third pair of doors are in their closed positions.

6. In combination with a fireplace opening including opposite side walls, a top wall and a lower hearth extending outwardly beyond said opening, an enclosure for said opening, said enclosure comprising a downwardly opening frame including a pair of upstanding opposite side members extending along the outer faces of said side walls and an upper horizontal member extending and connected between the upper ends of said upstanding members, said upper member extending along and conforming to the general contour of the front face of said top wall extending between the upper ends of said side walls, an elongated horizontal top panel extending along and supported from the lower marginal portion of said horizontal member and projecting outwardly of the latter, the opposite end edge portions of said top panel being angled outwardly toward the remote ends thereof, said top panel including an outer marginal edge extending between the outer ends of said end edge portions generally paralleling the front face of said top wall, a lower partial front wall closely overlying said hearth, spaced below said top wall and including a central portion generally paralleling said outer marginal edge and angled opposite end sections spaced below and generally paralleling said end edge portions with the remote ends of said angled end sections anchored to the lower ends of said side members, a pair of door assemblies, each door assembly comprising first and second door sections pivotally joined together along adjacent upstanding edges thereof, the upstanding edge of each first door section remote from the corresponding second door section being hinged from a corresponding side member of said frame and each door assembly being swingable into and out of position with its first door section closing that portion of the spacing between the adjacent angled end edge of said top wall and the corresponding lower front wall end section and its second door section bridging the adjacent ends of said top panel outer marginal edge and said lower partial front wall central portion, said door sections having openings formed therethrough closed by means of heat resistant transparent panels, the ends of upper marginal portions of the second door sections remote from the corresponding first door sections and said top panel including coacting latch means operative to releasably retain said door assemblies in the closed positions thereof, said coacting latch means including a single latch element shiftably supported from said top panel and simultaneously engageable with said second door sections, said single latch element and the upper marginal portions of said second door sections including coacting cam surfaces functioning to draw the upstanding edges of said second door sections toward each other as a result of said latch means being actuated to retain said door assemblies in the closed positions thereof.

* * * * *